US005122055A

United States Patent [19]

Yamaguchi

[11] Patent Number: 5,122,055

[45] Date of Patent: Jun. 16, 1992

[54] CASING FOR KILN

[75] Inventor: Minoru Yamaguchi, Ichinomiya, Japan

[73] Assignee: NGK Insulators, Ltd., Nagoya, Japan

[21] Appl. No.: 726,117

[22] Filed: Jun. 26, 1991

Related U.S. Application Data

[63] Continuation of Ser. No. 637,582, Jan. 4, 1991, abandoned.

[30] Foreign Application Priority Data

Feb. 20, 1990 [JP] Japan ..... 2-16074[U]

[51] Int. Cl.[5] ..... F27D 23/00

[52] U.S. Cl. ..... 432/76; 432/3; 432/237; 432/248; 432/241

[58] Field of Search ..... 432/3, 76, 237, 248, 432/128, 241

[56] References Cited

U.S. PATENT DOCUMENTS 2,448,723 9/1948 Mayer ..... 432/76
3,977,824 8/1976 Korting et al. ..... 432/251
4,764,108 8/1988 Carthew et al. ..... 432/3

FOREIGN PATENT DOCUMENTS 0090097 10/1983 European Pat. Off. .
2029149 12/1971 Fed. Rep. of Germany .
2268236 11/1975 France .

*Primary Examiner*—Henry C. Yuen
*Attorney, Agent, or Firm*—Armstrong & Kubovcik

[57] ABSTRACT

A casing for a kiln includes at least one casing unit comprising: vertical and horizontal frame members assembled according to the shape of a framework of the kiln; outer plates secured to at least one of the vertical and horziontal frame members for covering the spacings encircled by said vertical and horizontal frame members; guide fittings provided at the spacings between outer plates adjacent in a longitudinal direction of the kiln for slidably supporting the ends of said outer plates; and securing means for securing said outer plates to said vertical frame member or horizontal frame member so that the spacings between the adjacent outer plates are expandable in a longitudinal direction of the kiln.

9 Claims, 5 Drawing Sheets

CASING FOR KILN

This application is a continuation of application Ser. No. 07/637,582 filed Jan. 4, 1991, now abandoned.

BACKGROUND OF THE INVENTION

1. Field of the Invention

The present invention relates to a casing used for industrial kilns, and more particularly to an improved casing for tunnel-shaped kilns.

2. Prior Art

A conventional roller hearth kiln known as an industrial kiln has a kiln made of refractory bricks in the form of a tunnel, which is housed or stored in a casing made of heat resisting steel. The casings are connected in the longitudinal direction of the kiln to form a tunnel-shaped kiln in order of several tens meters in total length usually. FIGS. 9(*a*), 9(*b*) and 9(*c*) in the accompanying drawings show a conventional casing unit. A casing unit 1 comprises horizontal frame members 2 provided in a longitudinal direction of the kiln, horizontal frame members 3 provided on the bottom of the kiln in an axial direction of rollers (not shown) and vertical frame members 4 vertically erecting at both ends of the horizontal frame members 3. Bottom plates 7 and side plates 5 are fixed to the inner side frame members 2, 3 and 4 along the outer periphery thereof by spot welding. Supporting fittings 6 are provided between the upper vertical frame members 4 and the lower vertical frame members 4. Rollers indicated by dotted line 8 in FIG. 9(*c*), are inserted in a width direction of the kiln. A plurality of rollers 8 are lined in a parallel relationship with each other in a longitudinal direction of the kiln.

However, a problem with such a conventional casing for kilns is that the total length of the kiln increases during firing operations. The side plates 5 and the bottom plates 7 adjacent in a longitudinal direction of the kiln and welded to each other expand themselves according to the high temperature, which causes accumulation in total length. As a result, the total length of the casing increases so that the distance between the kiln and the peripheral devices provided in front of and in the rear of the kiln is changed to cause troubles.

In addition, when the side plates 5 and the bottom plates 7 do not perform thermal expansion smoothly, the adjacent side plates 5 and the bottom plates 7 themselves compress and interfere with each other, resulting in deformation of the casing and dislocation of the kiln center, which often leads to misalignment of the kiln itself particularly when the temperature of the kiln is elevated or lowered. Distortion also occurs in the pipings or ducts around the kiln.

SUMMARY OF THE INVENTION

It is therefore an object of the present invention to provide an improved kiln casing preventing the increase in total length of the casing caused by the heat conducted from inside of the kiln, and the remarkable increase in total length of the kiln.

Another object of the present invention is to provide an improved kiln casing preventing occurrence of the malfunction of the kiln and the peripheral devices around the kiln.

To this end, the present invention provides a casing for a kiln including at least one casing unit, which comprises vertical and horizontal frame members, outer plates, guide fittings and securing means. The vertical and horizontal frame members are assembled according to the shape of a framework of the kiln. The outer plates are secured to at least one of the vertical or horizontal frame members and cover the spacings encircled by said vertical and horizontal frame members. The guide fittings are provided at the spacings between outer plates adjacent in a longitudinal direction of the kiln and support the ends of said outer plates slidably in the longitudinal direction thereof. A means for securing said outer plates to said vertical frame members or horizontal frame members is provided so that the adjacent outer plates have elastic spacings between the both outer plates in a longitudinal direction of the kiln.

The outer plates may comprise side plates disposed on the side wall of the casing unit.

The outer plates may comprise bottom plates disposed on the bottom wall of the casing unit.

The securing means may include welding.

The securing means may include a bolt.

The securing means of the outer plates may be located in the vicinity of the center of both opposite ends of the outer plates in a longitudinal direction of the kiln.

The securing means of the outer plates may be located on two or three positions in the vicinity of the center of the both opposite ends of the outer plates in the longitudinal direction of the kiln.

The casing may include a plurality of the casing units linked with each other in the longitudinal direction of the kiln.

In such an arrangement, the outer plates are supported slidably relative to the vertical or horizontal frame members. The ends of the outer plates are supported by guide fittings slidably in a longitudinal direction of the kiln, so that the ends thereof are slidable in the longitudinal direction of the kiln. The outer plates adjacent in the longitudinal, direction expand freely in a longitudinal direction of the kiln in a spacing formed between the adjacent outer plates so that the adjacent outer plates will not interfere with each other. Accordingly, when the outer plates expand thermally, the casing does not expand remarkably in total length.

BRIEF DESCRIPTION OF THE DRAWINGS

FIG. 9(*b*) is an elevational view of the casing units shown in FIG. 9(*a*).

FIG. 9(*c*) is a front view of the casing units of FIG. 9(*a*).

DETAILED DESCRIPTION OF THE PREFERRED EMBODIMENT

In FIGS. 1 through 8, a casing for a kiln constructed according to the present invention is shown.

The casing for a kiln is used for a roller hearth kiln. The roller hearth kiln comprises casing units linked with each other in a longitudinal direction of the kiln, and is in order of several tens meters in total length.

Figure 5:
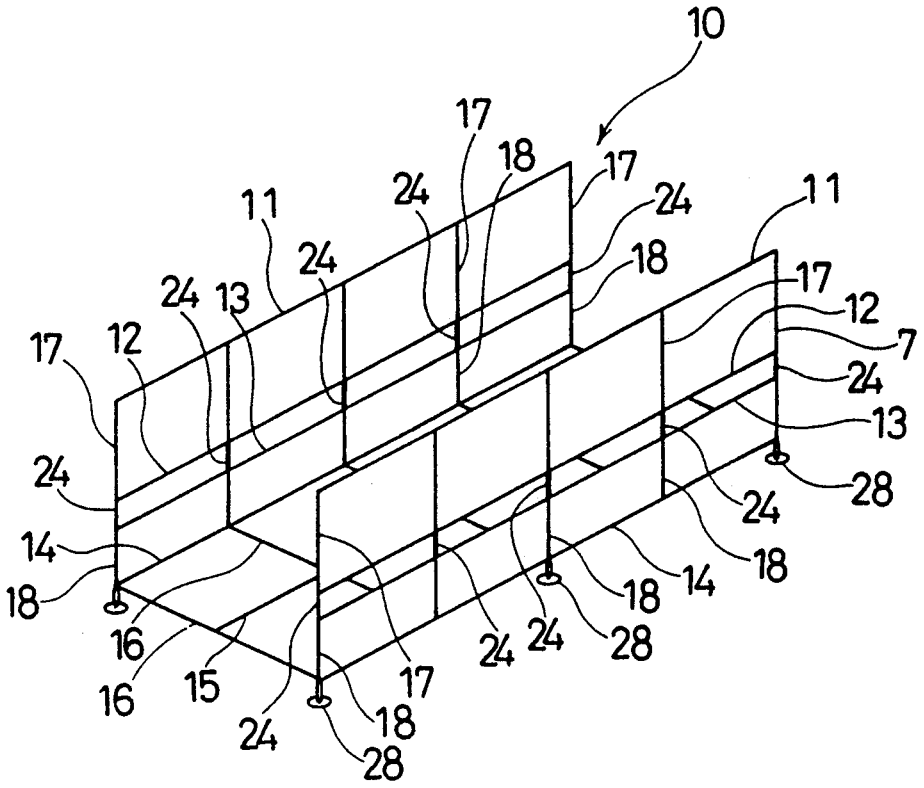
FIG. 5 is a perspective view showing horizontal and vertical frame members.

A casing unit 10 comprises frame members and horizontal frame members as shown in FIG. 5.

Referring to the frame members, a horizontal top frame member 11, a horizontal upper frame member 12, a horizontal lower frame member 13, and a horizontal bottom frame member 14 are provided in a longitudinal direction of the kiln. A horizontal bottom intermediate frame member 15 is provided between the horizontal bottom frame members 14, which are provided at the opposite ends of the casing unit 10. A horizontal bottom link frame member 16 connecting the horizontal bottom frame members 14 with each other at the opposite ends is provided at the bottom of the casing unit 10 in a width direction of the kiln.

The vertical frame members comprise a vertical upper frame member 17 and a vertical lower frame member 18. The horizontal top frame member 11 is linked with the horizontal upper frame member 12 by the vertical upper frame member 17. The horizontal lower frame member 13 is linked with the horizontal bottom frame member 14 by the vertical lower frame member 18. A jack bolt 28 is mounted to the lower end of the vertical lower frame member 18. A supporting means 24 is mounted between the vertical upper frame member 17 and the vertical lower frame member 18.

Figure 1:
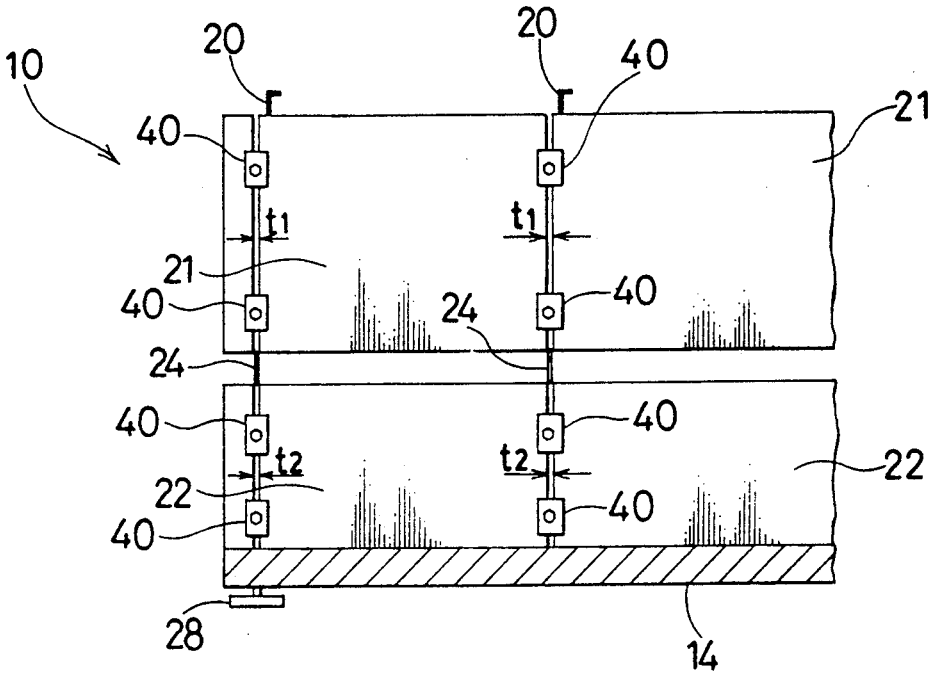
FIG. 1 is a partial elevational view showing the inner side of a casing for a kiln in accordance with the present invention.
Figure 2:
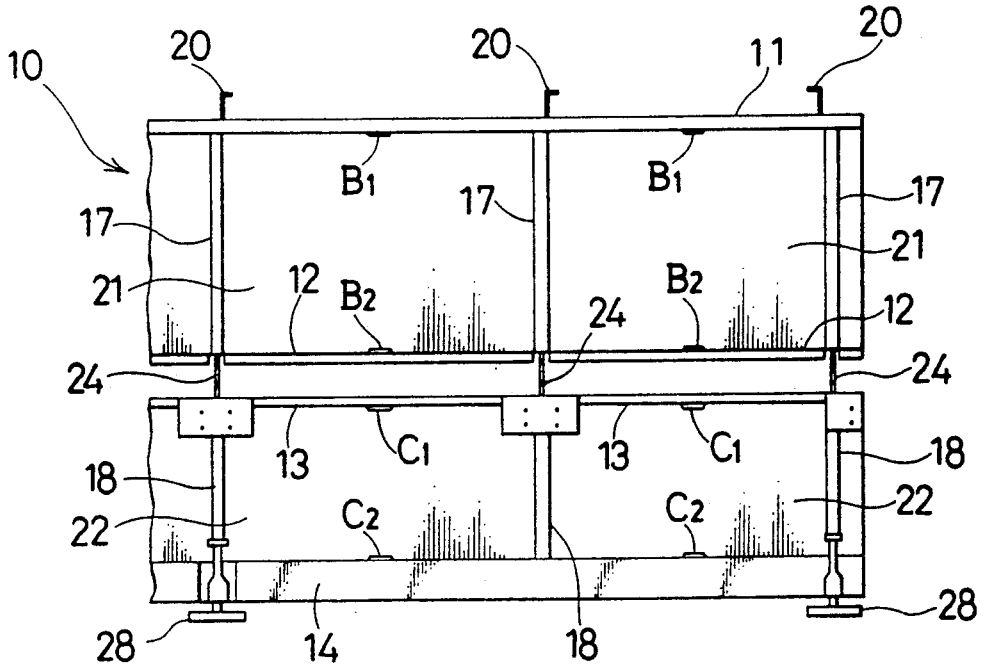
FIG. 2 is a partial elevational view showing the outer side of the casing.

Now an outer plate will be described. As shown in FIGS. 1 and 2, upper side plates 21 are welded to the horizontal top frame member 11 and the horizontal upper frame member 12 respectively at upper and lower intermediate portions $B_1$ and $B_2$ thereof, so that they are located within rectangular spaces encircled by the horizontal top frame member 11, the horizontal upper frame member 12 and the vertical upper frame member 17. Lower side plates 22 are welded to the horizontal upper frame members 13 and the horizontal bottom frame members 14 respectively at the upper and lower intermediate portions $C_1$ and $C_2$, so that they are located within rectangular spaces encircled by the horizontal lower frame member 13, the horizontal bottom frame member 14 and the vertical lower frame member 18.

Figure 6:
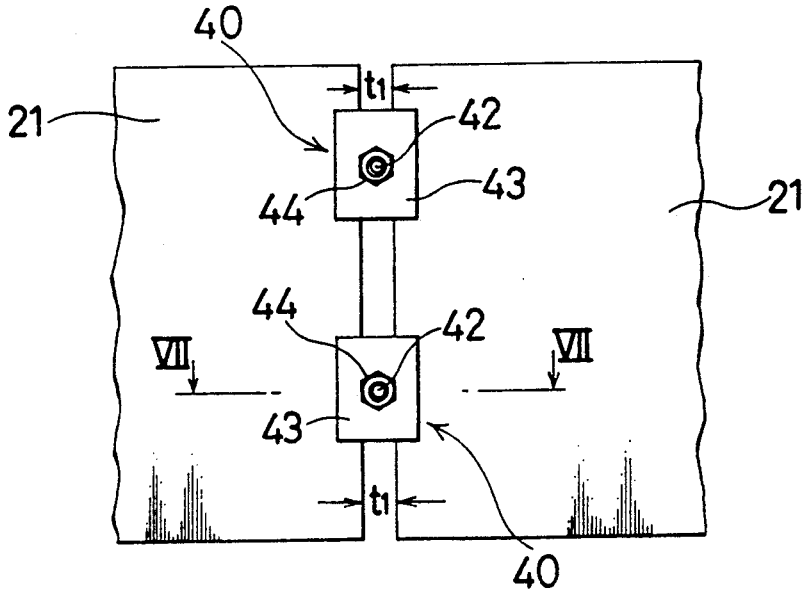
FIG. 6 is a plan view showing the mounting conditions of guide fittings.
Figure 7:
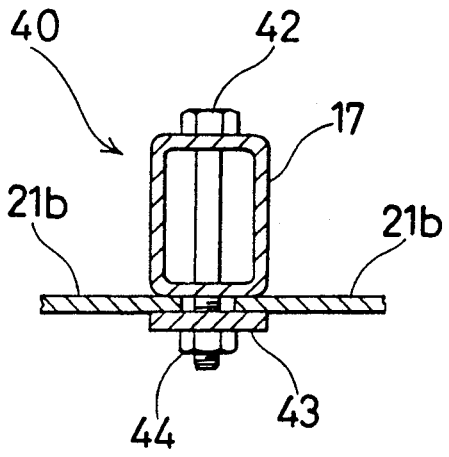
FIG. 7 is a sectional view taken along a line VII—VII in FIG. 6.

As shown in FIGS. 1 and 6, guide fittings 40 are provided in spacings $t_1$ formed between adjacent upper side plates 21. As shown in FIG. 7, each of the guide fittings 40 comprises a bolt 42 which extends through the vertical upper frame member 17 provided on outside of the kiln with respect to the upper side plate 21, a pressing plate 43 located in the inside of the kiln and a nut 44 threadingly engaged with the bolt 42. The guide fittings 40 are secured to the upper side plates 21 by fastening the bolt 42 and nut 44. The end **21*b* of the upper side plates 21 are slidable in right and left directions as viewed in FIG. 7**.

Figure 8:
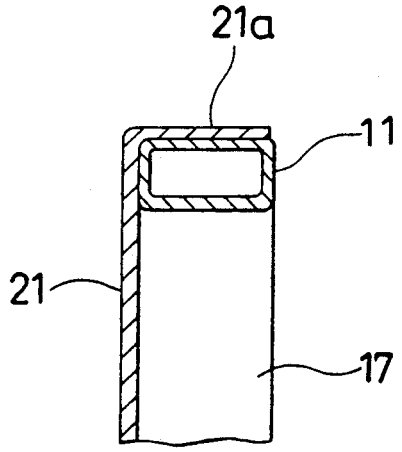
FIG. 8 is an enlarged view of VIII portion in FIG. 3.
Figure 9A:
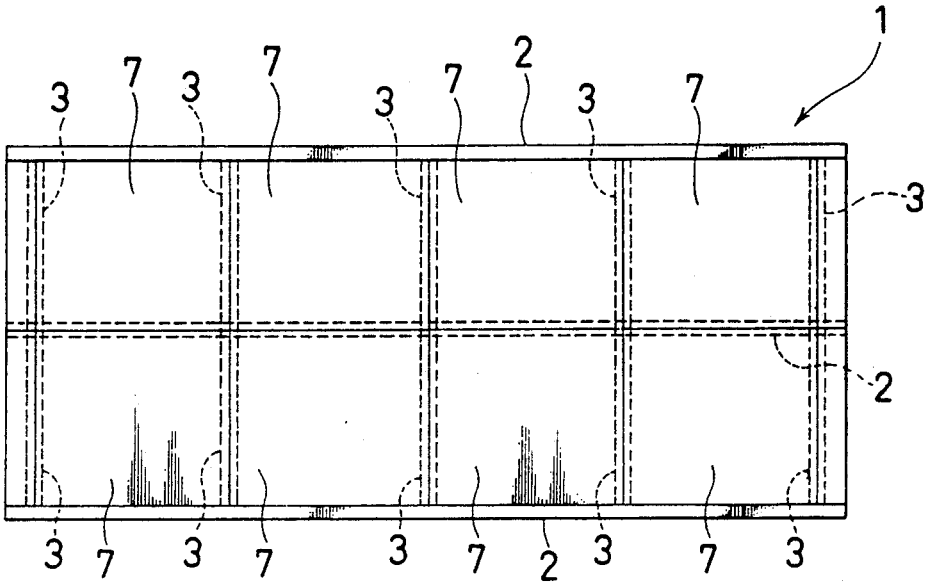
FIG. 9(*a*) is a plan view of a casing unit in accordance with the prior art.
Figure 9B:
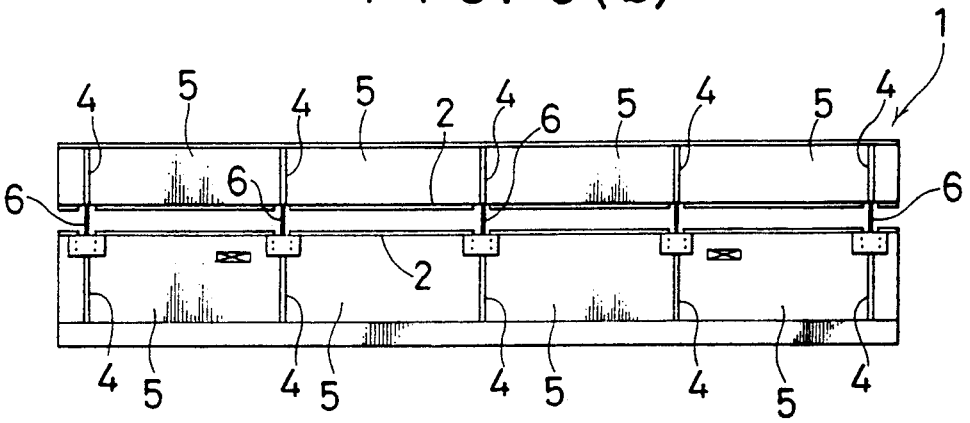
Figure 9C:
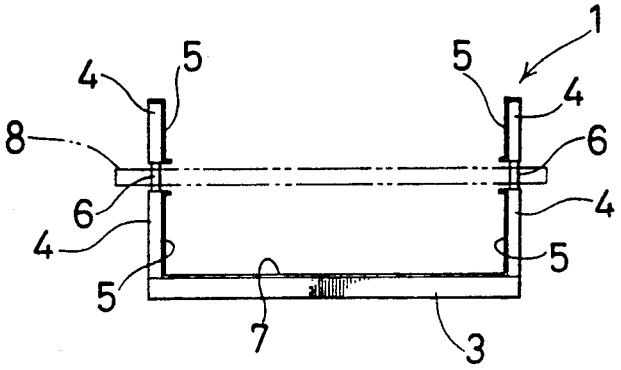

The upper side plate 21 has a bent portion **21*a* which is horizontally bent at the top thereof as shown in FIG. 8. The bent portion 21*a* is slidable along the horizontal upper frame member 11. This enables the bent portion 21*a* to freely expand or contract relative to the horizontal top frame member 11 in a longitudinal direction of the kiln when the upper side plate 21** is thermally expanded.

Figure 3:
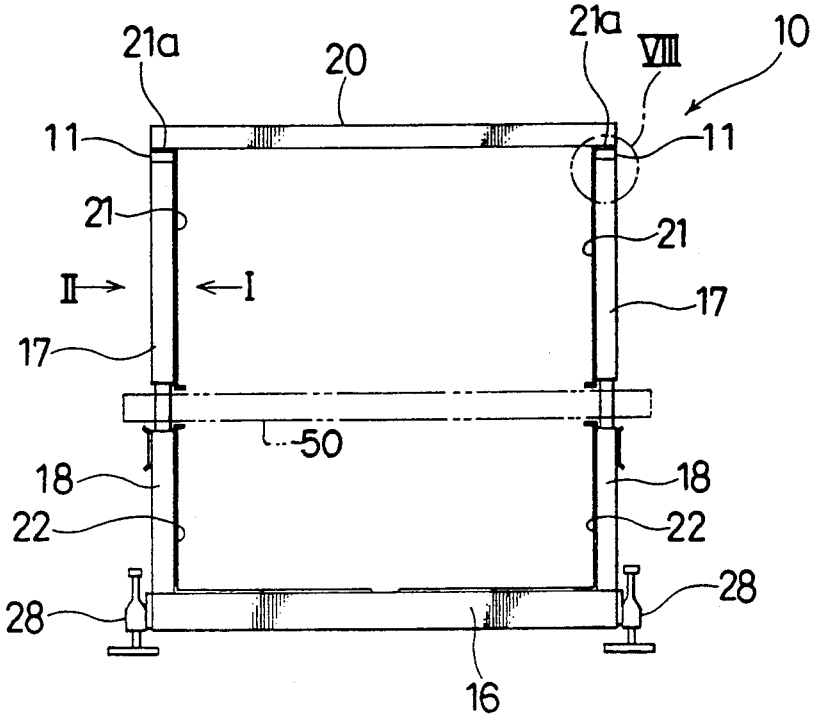
FIG. 3 is a front view of the casing.
Figure 4:
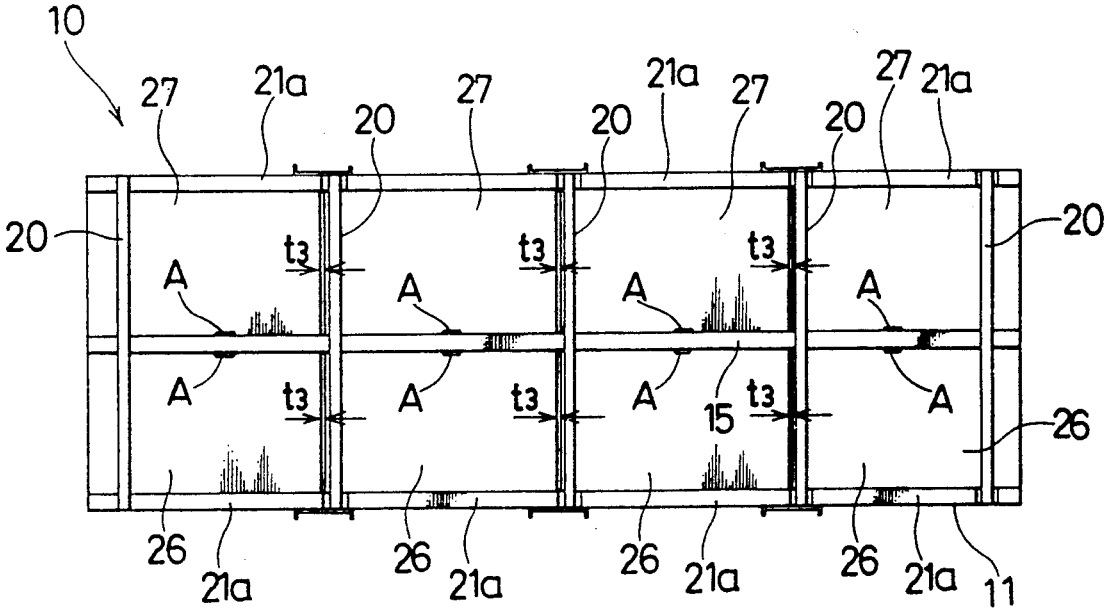
FIG. 4 is a plan view of the casing.

As shown in FIGS. 3 and 4, ceiling members 20 are rested on the bent portions **21*a* of the upper side plates 21. The bottom plates 26 and 27 used as outer plates are located in a space encircled by the horizontal bottom frame member 14, the horizontal bottom intermediate frame member 15 and the horizontal bottom linking member 16. The bottom plates 26 and 27 are welded to the horizontal bottom intermediate frame members 15 at the positions shown by A. The bottom plates 26 and 26, bottom plates 27 and 27 are adjacent to with each other in a longitudinal direction of the kiln, and spaced at a spacing $t_3$ between the each of them, wherein the bottom plates 26 and 27 expand or contract freely. A kiln body is disposed within the described casing unit 10. When a kiln casing is provided with a kiln, a number of ceramic rollers indicated by dotted line 50** bridge over the width of the kiln and have spacings between each pair of adjacent rollers in the longitudinal direction of the kiln.

In the casing unit 10 subjected to heat from the kiln, the upper and lower side plates 21 and 22 extend in a longitudinal direction of the kiln while the side plates 21 and 22 are secured to the frame members 11, 12, 13 and 14 at the described welded points. At this time, the end portion of the upper side plate will not interfere with the end portion of the lower side plate since the spacings $t_1$ and $t_1$ absorb the expansion of the side plates. At the same time the adjacent bottom plates 27 and 27, 26 and 26 will not interfere with each other since the spacing $t_3$ absorbs the expansion of the adjacent bottom plates. Accordingly, the total length of the casing unit 10 will not increase remarkably and the total length of the casing will not increase remarkably either, since such casing units are linked with each other in a longitudinal direction of a kiln and form the casing for the kiln. As a result, the casing prevents the kiln from interfereing with peripheral equipment and piping, which are provided in front of or at the rear of the kiln.

In the above mentioned embodiment, means for securing the frame members 11 through 16 to the upper side plate 21 and lower side plates 22 or the bottom plates 26 and 27 functioning as outer plates is welding. However, it will be recongnized that there are other equivalent means of securing in the present invention such as bolts or other fastening means. It is desirable to fix the outer plates in opposite positions in the vicinity of the center thereof. It would be possible to fix the side plates at one point located upper and center thereof and to secure the lower end of the side plates by the guide fittings. It would be also possible to fix the side plates at a plural number of positions for sound securing, for example, a several positions in the vicinity of the center of the side plates.

As will be apparent from the foregoing, the present invention provides an improved casing for kiln, wherein the ends of the outer plates in the longitudinal direction of the kiln are free from the vertical frame members or horizontal frame members. Therefore, the outer plates adjacent with each other in the longitudinal direction will freely expand or contract without interfering with each other according to thermal expansion or contraction. As a result, such advantages are achieved that the casing will not expand remarkably in total length and will not interfere with pieripheral equipment and ducts around the kiln, and hence will ensure the safety of the kiln.

I claim:

1. A casing for a kiln including at least one casing unit comprising:

vertical and horizontal frame members assembled according to the shape of a framework of the kiln;

outer plates secured to at least one of the vertical or horizontal frame members for covering the openings encircled by said vertical and horizontal frame members;

securing means for securing said outer plates to said at least one of the vertical or horizontal frame members so that outer plates adjacent in a longitudinal direction of the kiln have elastic spacings therebetween at positions corresponding to vertical frame members, said securing means being located in the vicinity of the center of an outer plate relative to the horizontal direction of the kiln; and guide fittings provided at the elastic spacings between adjacent outer plates for slidably supporting the ends of said outer plates.

2. A casing for a kiln as defined in clain 1 wherein said outer plates comprise side plates disposed on a side wall of the casing unit.

3. A casino for a kiln as defined in claim 1 wherein said outer plates comprise bottom plates disposed on the bottom wall of the casing unit.

4. A casing for a kiln as defined in claim 1 wherein said securing means includes welding.

5. A casing for a kiln as defined in claim 1 wherein said securing means includes a bolt.

6. A casing for a kiln as defined in claim 1 wherein said casing includes a plurality of the casing units linked with each other in the longitudinal direction of the kiln.

7. A casing for kiln as defined in claim 1 wherein a plurality of guide fittings are provided at an elastic spacing betwen adjacent outer plates.

8. A casing for a kiln as defined in claim 1 wherein both edges of said horizontal frame members are coupled to said vertical frame members.

9. A casing for a kiln as defined in claim 1 wherein each of said guide fittings includes a bolt which extends through an entire cross-section of one of said vertical frame members and provided outside of said kiln with respect to corresponding ones of said outer plates, and wherein each of said guide fittings further includes a pressing plate located inside said kiln and a nut threadingly engaged with said bolt.

* * * * *